US010997912B2

(12) United States Patent
Ishii et al.

(10) Patent No.: US 10,997,912 B2
(45) Date of Patent: May 4, 2021

(54) METHOD OF DRIVING DISPLAY PANEL, DRIVING CIRCUIT, AND DISPLAY UNIT

(71) Applicant: JOLED INC., Tokyo (JP)

(72) Inventors: Hiroaki Ishii, Tokyo (JP); Atsushi Hyodo, Kanagawa (JP); Teppei Isobe, Kanagawa (JP)

(73) Assignee: JOLED INC., Tokyo (JP)

( * ) Notice: Subject to any disclaimer, the term of this patent is extended or adjusted under 35 U.S.C. 154(b) by 97 days.

(21) Appl. No.: 16/423,155

(22) Filed: May 28, 2019

(65) Prior Publication Data

US 2020/0027395 A1 Jan. 23, 2020

(30) Foreign Application Priority Data

Jul. 17, 2018 (JP) ..... JP2018-134163

(51) Int. Cl.
*G09G 3/3233* (2016.01)
*G09G 3/20* (2006.01)

(52) U.S. Cl.
CPC ..... *G09G 3/3233* (2013.01); *G09G 3/2007* (2013.01); *G09G 2300/0819* (2013.01); *G09G 2310/0202* (2013.01); *G09G 2320/0247* (2013.01); *G09G 2330/028* (2013.01)

(58) Field of Classification Search
CPC ... G09G 2300/0819; G09G 2310/0202; G09G 2320/0247; G09G 2320/045; G09G 2330/028; G09G 3/2007; G09G 3/3233; G09G 2300/0842; G09G 2300/0866; G09G 2320/043; G09G 3/3291
See application file for complete search history.

(56) References Cited

U.S. PATENT DOCUMENTS 8,259,755 B2 * 9/2012 Pontius ..... H04L 25/14 370/503
8,847,999 B2 * 9/2014 Toyomura ..... G09G 3/3225 345/690
2008/0030436 A1 * 2/2008 Iida ..... G09G 3/3266 345/77
2009/0073095 A1 3/2009 Uchino et al.
2009/0322730 A1 * 12/2009 Yamamoto ..... G09G 3/3659 345/213

(Continued)

FOREIGN PATENT DOCUMENTS

JP 200969552 A 4/2009
JP 2015-125356 A 7/2015

*Primary Examiner* — Kenneth Bukowski
(74) *Attorney, Agent, or Firm* — Hauptman Ham, LLP

(57) ABSTRACT

A method of driving a display panel includes: correcting a gate-source voltage of a first transistor to cause the gate-source voltage of a first transistor to become closer to a threshold voltage of the first transistor; and writing a signal voltage into a gate of the first transistor by applying a plurality of voltage pulses to a gate of a second transistor. The correcting and the writing are performed in each of pixels of the display panel. The signal voltage corresponds to an image signal. The voltage pulses applied in the writing include a first voltage pulse and a second voltage pulse. The first voltage pulse is applied previous to the second voltage pulse. The second voltage pulse is applied subsequent to the first voltage pulse. A peak value of the first voltage pulse is higher than a peak value of the second voltage pulse.

7 Claims, 8 Drawing Sheets

(56) References Cited

U.S. PATENT DOCUMENTS

| | | | | |
|---|---|---|---|---|
| 2014/0139411 | A1* | 5/2014 | Jinta | G09G 3/3233 345/80 |
| 2015/0187277 | A1 | 7/2015 | Maeyama et al. | |
| 2015/0243225 | A1* | 8/2015 | Maeyama | G09G 3/3406 345/691 |

* cited by examiner

METHOD OF DRIVING DISPLAY PANEL, DRIVING CIRCUIT, AND DISPLAY UNIT

CROSS REFERENCE TO RELATED APPLICATIONS

This application claims the benefit of Japanese Priority Patent Application No. 2018-134163 filed on Jul. 17, 2018, the entire contents of which are incorporated herein by reference.

BACKGROUND

The disclosure relates to a method of driving a display panel, and to a driving circuit and a display unit.

A variety of display units have been proposed that include light-emitting elements, such as organic electroluminescent (EL) elements. Reference is made to Japanese Unexamined Patent Application Publication No. 2015-125356.

SUMMARY

A display unit sometimes experiences a change in emission response of a light-emitting element depending on an electric current or a gray-scale level. Such a change in the emission response can generate flickers, which can lead to deterioration of display quality.

It is desirable to provide a method of driving a display panel that makes it possible to reduce generation of flickers, and a driving circuit and a display unit that make it possible to reduce the generation of flickers.

According to one embodiment of the disclosure, there is provided a method of driving a display panel. The display panel includes a plurality of pixels. Each of the pixels includes a light-emitting element and a pixel circuit. The pixel circuit includes a first transistor and a second transistor. The first transistor is configured to control an electric current flowing in the light-emitting element. The second transistor is configured to control an application of a voltage to a gate of the first transistor. The method includes: correcting a gate-source voltage of the first transistor in any of the pixels to cause the gate-source voltage of the first transistor to become closer to a threshold voltage of the first transistor; and writing, after the correcting the gate-source voltage, a signal voltage into the gate of the first transistor in the any of the pixels by applying a plurality of voltage pulses to a gate of the second transistor. The signal voltage corresponds to an image signal. The voltage pulses applied in the writing include a first voltage pulse and a second voltage pulse. The first voltage pulse is applied previous to the second voltage pulse, and the second voltage pulse is applied subsequent to the first voltage pulse. A peak value of the first voltage pulse is higher than a peak value of the second voltage pulse.

According to one embodiment of the disclosure, there is provided a driving circuit configured to drive a display panel. The display panel includes a plurality of pixels. Each of the pixels includes a light-emitting element and a pixel circuit. The pixel circuit includes a first transistor and a second transistor. The first transistor is configured to control an electric current flowing in the light-emitting element. The second transistor is configured to control an application of a voltage to a gate of the first transistor. The driving circuit includes: writing circuitry configured to correct a gate-source voltage of the first transistor in any of the pixels to cause the gate-source voltage to become closer to a threshold voltage of the first transistor, and write, after correcting the gate-source voltage, a signal voltage into the gate of the first transistor in the any of the pixels by applying a plurality of voltage pulses to a gate of the second transistor. The signal voltage corresponds to an image signal. The voltage pulses applied when the writing circuitry writes the signal voltage includes a first voltage pulse and a second voltage pulse. The first voltage pulse is applied previous to the second voltage pulse, and the second voltage pulse is applied subsequent to the first voltage pulse. A peak value of the first voltage pulse is higher than a peak value of the second voltage pulse.

According to one embodiment of the disclosure, there is provided a display unit including: a display panel and a driving circuit configured to drive the display panel. The display panel includes a plurality of pixels. Each of the pixels includes a light emitting element and a pixel circuit. The pixel circuit includes a first transistor and a second transistor. The first transistor is configured to control an electric current flowing in the light-emitting element. The second transistor is configured to control an application of a voltage to a gate of the first transistor. The driving circuit is configured to correct a gate-source voltage of the first transistor in any of the pixels to cause the gate-source voltage to become closer to a threshold voltage of the first transistor, and write, after correcting the gate-source voltage, a signal voltage into the gate of the first transistor in the any of the pixels by applying a plurality of voltage pulses to a gate of the second transistor. The signal voltage corresponds to an image signal. The voltage pulses applied when the writing circuitry writes the signal voltage include a first voltage pulse and a second voltage pulse. The first voltage pulse is applied previous to the second voltage pulse, and the second voltage pulse is applied subsequent to the first voltage pulse. A peak value of the first voltage pulse is higher than a peak value of the second voltage pulse.

BRIEF DESCRIPTION OF THE DRAWINGS

The accompanying drawings are included to provide a further understanding of the disclosure and are incorporated in and constitute a part of this specification. The drawings illustrate example embodiments and, together with the specification, serve to explain the principles of the disclosure.

DETAILED DESCRIPTION

Figure 1:
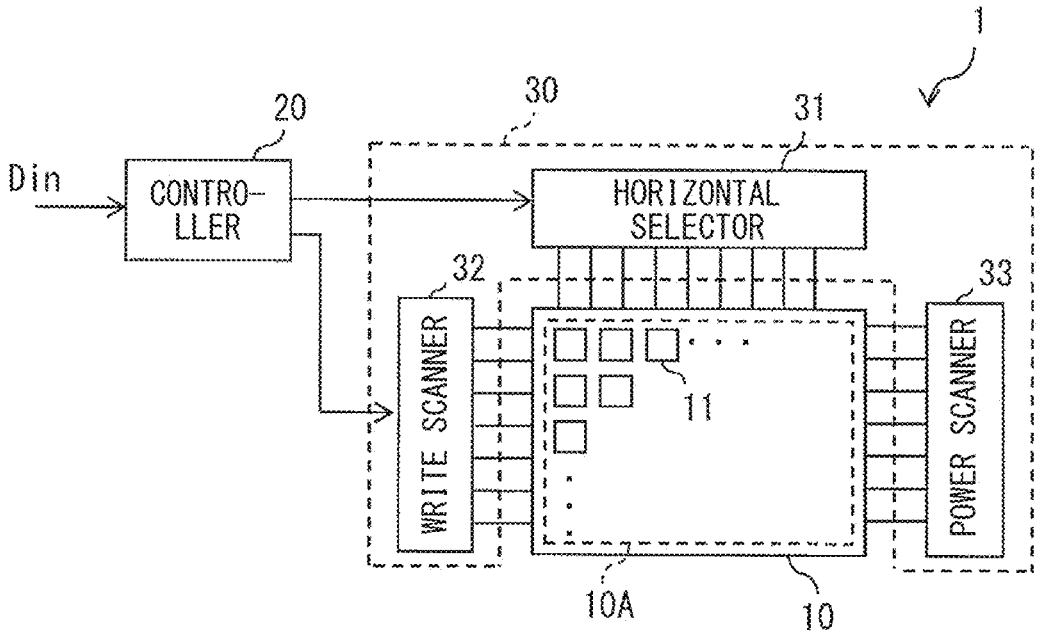
FIG. 1 is a schematic diagram illustrating an example configuration of a display unit according to one example embodiment of the disclosure.

In the following, some example embodiments, modification examples, and application examples of the disclosure are described in detail, in the following order, with reference to the accompanying drawings. Note that the following description is directed to illustrative examples of the disclosure and not to be construed as limiting to the disclosure. Factors including, without limitation, numerical values, shapes, materials, components, positions of the components, and how the components are coupled to each other are illustrative only and not to be construed as limiting to the disclosure. Further, elements in the following example embodiments which are not recited in a most-generic independent claim of the disclosure are optional and may be provided on an as-needed basis. The drawings are schematic and are not intended to be drawn to scale. Note that the like elements are denoted with the same reference numerals, and any redundant description thereof will not be described in detail. Note that the description is given in the following order.

1. Embodiments (Display Unit)
2. Modification Examples (Display Unit)
3. Application Examples (Electronic Apparatuses)

1. Embodiments

[Configuration]

Figure 2:
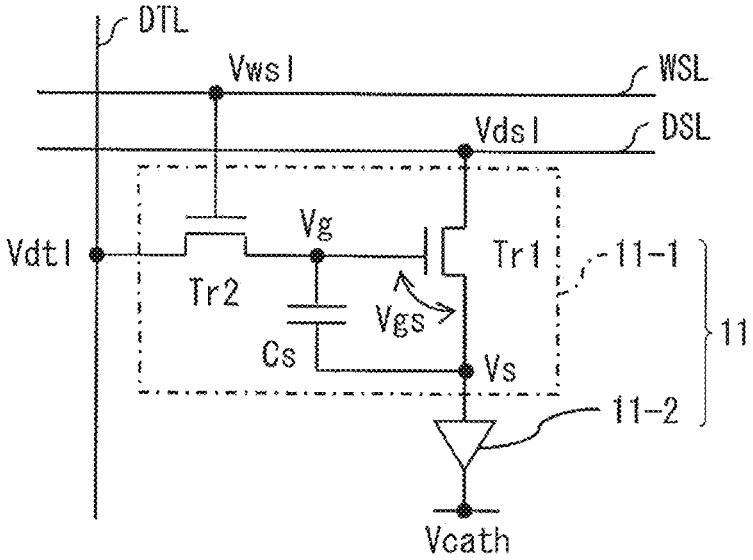
FIG. 2 is an example circuit diagram of each of pixels illustrated in FIG. 1.

FIG. 1 schematically illustrates an example configuration of a display unit 1 according to an example embodiment of the disclosure. FIG. 2 illustrates an example circuit configuration of each pixel 11 in the display unit 1. The display unit 1 includes, for example, a display panel 10, a controller 20, and a driver 30. The controller 20 and the driver 30 may correspond to a specific but non-limiting example of "driving circuit" according to one embodiment of the disclosure. The display panel 10 may have an image display surface 10A. The image display surface 10A may be provided with a plurality of pixels 11 that are arranged in matrix. The driver 30 may be mounted on an outer edge portion of the display panel 10, such as a peripheral portion of the image display surface 10A. The controller 20 and the driver 30 drive the display panel 10 (i.e., the pixels 11) on the basis of an external image signal Din.

[Display Panel 10]

Each of the pixels 11 of the display panel 10 may be driven by the controller 20 and the driver 30 through an active matrix scheme, causing the display panel 10 to display an image based on the external image signal Din on the image display surface 10A. The display panel 10 may include, for example, a plurality of scanning lines WSL extending in a row direction, a plurality of signal lines DTL extending in a column direction, and a plurality of power lines DSL extending in the row direction. The display panel 10 may further include the plurality of pixels 11. Each of the pixels 11 is disposed at an intersection between one of the scanning lines WSL and corresponding one of the signal lines DTL.

The scanning lines WSL may supply each of the pixels 11 with a selection pulse to select the pixels 11 on a predetermined unit basis, for example, on a pixel row basis. The selection pulse may correspond to a specific but non-limiting example of "voltage pulse" according to one embodiment of the disclosure. The signal lines DTL may supply each of the pixels 11 with a voltage outputted from a horizontal selector 31 described below. For example, the voltage outputted from the horizontal selector 31 may be an offset voltage Vofs, a signal voltage Vsig1, a signal voltage Vsig2 corresponding to the image signal Din, or a sum voltage of the signal voltage Vsig2 and a correction voltage ΔVc, as described below. The power lines DSL may supply each of the pixels 11 with electric power.

The signal lines DTL may be each coupled to an output terminal of the horizontal selector 31. Each of the signal lines DTL may be allocated to its corresponding pixel column, for example. The scanning lines WSL may be each coupled to an output terminal of a write scanner 32 described below. Each of the scanning lines WSL may be allocated to its corresponding pixel row, for example. The power lines DSL may be each coupled to an output terminal of a power scanner 33 described below. Each of the power lines DSL may be allocated to its corresponding pixel row, for example.

Each of the pixels 11 includes a pixel circuit 11-1 and an organic electroluminescent element 11-2. In other words, the display panel 10 includes the pixel circuit 11-1 and the organic electroluminescent element 11-2 in each of the pixels 11. The organic electroluminescent element 11-2 may correspond to a specific but non-limiting example of "light-emitting element" according to one embodiment of the disclosure. The organic electroluminescent element 11-2 may have a multi-layer structure that includes, in order, an anode electrode, an organic layer, and a cathode electrode, for example. The organic electroluminescent element 11-2 may include a capacitor Coled. The pixel circuit 11-1 may control light emission and light extinction of the organic electroluminescent element 11-2. The pixel circuit 11-1 may hold a voltage written into corresponding one of the pixels 11 through write scanning described below. The pixel circuit 11-1 may include, for example, a driving transistor Tr1, a switching transistor Tr2, and a storage capacitor Cs. Note that the configuration of the pixel circuit 11-1 described above is a non-limiting example, and the pixel circuit 11-1 may have any configuration other than the configuration described above. The driving transistor Tr1 may correspond to a specific but non-limiting example of "first transistor" according to one embodiment of the disclosure. The switching transistor Tr2 may correspond to a specific but non-limiting example of "second transistor" according to one embodiment of the disclosure.

The switching transistor Tr2 may control an application of a voltage to a gate of the driving transistor Tr1. For example, the switching transistor Tr2 may sample a voltage Vdt1 of the signal line DTL, and may write the sampled voltage into the gate of the driving transistor Tr. The driving transistor Tr1 may be coupled in series to the organic electroluminescent element 11-2. The driving transistor Tr1 may drive the organic electroluminescent element 11-2. The driving transistor Tr1 may control an electric current flowing in the organic electroluminescent element 11-2 on the basis of the amount of the voltage sampled at the switching transistor Tr2. The switching transistor Tr2 may control a gate voltage Vg of the driving transistor Tr1 during a correction that causes a gate-source voltage Vgs of the driving transistor Tr1 to become closer to a threshold voltage Vth of the driving transistor Tr1. The correction may be hereinafter referred to as a "threshold correction". The storage capacitor Cs may hold a predetermined voltage between the gate and the source of the driving transistor Tr1. The storage capacitor Cs may be provided on an electrically-conductive path between the gate of the driving transistor Tr1 and the source of the driving transistor Tr1.

The driving transistor Tr1 and the switching transistor Tr2 may be n-channel MOS thin-film transistors (TFTs), for example. Alternatively, the driving transistor Tr1 and the switching transistor Tr2 may be p-channel MOS TFTs. The driving transistor Tr1 and the switching transistor Tr2 may be of an enhancement type or a depression type.

Each of the signal lines DTL may be coupled to the output terminal of the horizontal selector 31 and a source or a drain of the switching transistor Tr2. Each of the scanning lines WSL may be coupled to the output terminal of the write scanner 32 and a gate of the switching transistor Tr2. Each of the power lines DSL may be coupled to an output terminal of the power scanner 33 and the source or drain of the driving transistor Tr1.

The gate of the switching transistor Tr2 may be coupled to the scanning line WSL. One of the source and the drain of the switching transistor Tr2 may be coupled to the signal line DTL. The other of the source and the drain, uncoupled to the signal line DTL, of the switching transistor Tr2 may be coupled to the gate of the driving transistor Tr1. The gate of the driving transistor Tr1 may be coupled to the other of the source and the drain, uncoupled to the signal line DTL, of the switching transistor Tr2 and one terminal of the storage capacitor Cs. One of the source and the drain of the driving transistor Tr1 may be coupled to the power line DSL. The other of the source and drain, uncoupled to the power line DSL, of the driving transistor Tr1 may be coupled to an anode of the organic electroluminescent element 11-2. One end of the storage capacitor Cs may be coupled to the gate of the driving transistor Tr1. The other end of the storage capacitor Cs 1 may be coupled to one of the source and the drain, uncoupled to the power line DSL, of the driving transistor Tr1. A cathode of the organic electroluminescent element 11-2 may be coupled to a ground, for example.

The driver 30 may include the horizontal selector 31, the write scanner 32, and the power scanner 33, for example. Note that this configuration of the driver 30 is a non-limiting example, and the driver 30 may have any other configuration in accordance with the configuration of the pixel circuit 11-1.

The horizontal selector 31 may apply an analog voltage Vdt1 received from the controller 20 to any of the signal lines DTL in response to (in synchronization with) a control signal Tout supplied from the controller 20. For example, the horizontal selector 31 may supply the pixels 11 selected by the write scanner 32 with the voltage Vdt1 through the signal lines DTL.

The write scanner 32 may scan the pixels 11 on a predetermined unit basis. For example, the write scanner 32 may output a selection pulse to the scanning lines WSL in a sequential manner in one frame period, for example. The write scanner 32 may select the scanning lines WSL in a predetermined sequence in response to (in synchronization with) a control signal Tout supplied from the controller 20, for example, to execute writing of various voltages into any of the pixels 11 and light emission of any of the pixels 11 in a desired order. Specific but non-limiting examples of the various voltages may include the offset voltage Vofs, the signal voltage Vsig1, the signal voltage Vsig2, and a sum voltage of the signal voltage Vsig2 and the correction voltage ΔVc. The wording "writing of various voltages into any of the pixels 11" may refer to an operation of writing various voltages into the gate of the driving transistor Tr1 through the switching transistor Tr2. In other words, a combination of the horizontal selector 31 and the write scanner 32 may correspond to a specific but non-limiting example of "writing circuitry" according to one embodiment of the disclosure.

The write scanner 32 may output two voltages, i.e., an on-voltage Von and an off-voltage Voff. For example, the write scanner 32 may supply the pixel 11 to be driven with the two voltages Von and Voff through the scanning line WSL to perform an on/off control of the switching transistor Tr2. The on-voltage Von may be equal to or higher than an on-voltage of the switching transistor Tr2. The on-voltage Von may correspond to a peak value of a selection pulse outputted from the write scanner 32 in a "threshold correction period", a "first writing period", and a "second writing period" described below. The off-voltage Voff may be lower than the on-voltage of the switching transistor Tr2.

The power scanner 33 may select the power lines DSL in a sequential manner on a predetermined unit basis in response to (in synchronization with) the control signal Tout supplied from the controller 20, for example. The power scanner 33 may output two fixed voltages Vcc and Vss. For example, the power scanner 33 may supply the pixel 11 selected by the write scanner 32 with the two fixed voltages Vcc and Vss through the power lines DSL. The fixed voltage Vss may be lower than the sum of a threshold voltage Ve1 of the organic electroluminescent element 11-2 and a cathode voltage Vcath of the organic electroluminescent element 11-2 (i.e., Ve1+Vcath). The fixed voltage Vcc may be higher than the sum of the threshold voltage Ve1 of the organic electroluminescent element 11-2 and the cathode voltage Vcath of the organic electroluminescent element 11-2 (i.e., Ve1+Vcath).

[Controller 20]

The controller 20 will now be described. The controller 20 may perform a predetermined signal process to an external digital image signal Din, for example, and may generate the voltage Vdt1 and the control signal Tout. The controller 20 may output the generated voltage Vdt1 to the horizontal selector 31, for example, and may output the generated control signal Tout to the horizontal selector 31, the write scanner 32, and the power scanner 33, for example.

Figure 3:
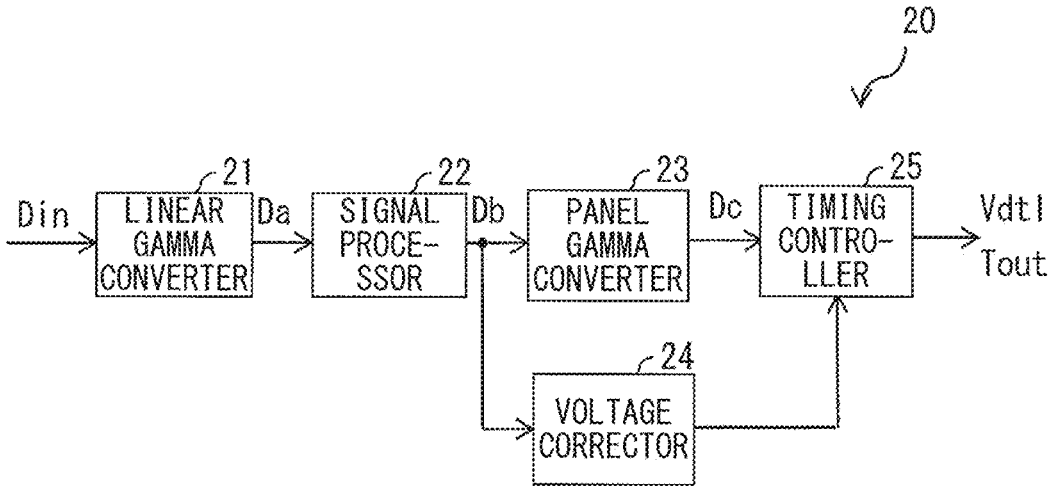
FIG. 3 is a block diagram illustrating an example configuration of a controller illustrated in FIG. 1.

FIG. 3 is a block diagram illustrating an example configuration of the controller 20. The controller 20 may include, for example, a linear gamma converter 21, a signal processor 22, a panel gamma converter 23, a voltage corrector 24, and a timing controller 25.

The linear gamma converter 21 may receive and convert the image signal Din into an image signal Da having a linear gamma characteristic. In other words, the image signal Din supplied from an external device may have a non-linear gamma characteristic and may have a gamma value of 2.2, for example, in accordance with a characteristic of a general display unit. The linear gamma converter 21 may convert the non-linear gamma characteristic into the linear gamma characteristic to facilitate a subsequent process. The linear gamma converter 21 may output, to the signal processor 22, the image signal Da obtained through the conversion. The signal processor 22 may perform various signal processes, such as an average picture level (APL) control, to the image signal Da, as needed. The signal processor 22 may output, to the panel gamma converter 23 and the voltage corrector 24, an image signal Db obtained through the various signal processes.

The panel gamma converter 23 may perform a gamma conversion to the image signal Db received from the signal processor 22, for example. In an example, the panel gamma converter 23 may convert the image signal Db having a linear gamma characteristic into an image signal Dc having a non-linear gamma characteristic in accordance with the characteristic of the display panel 10. The panel gamma converter 23 may output the image signal Dc to the timing controller 25.

Figure 6:
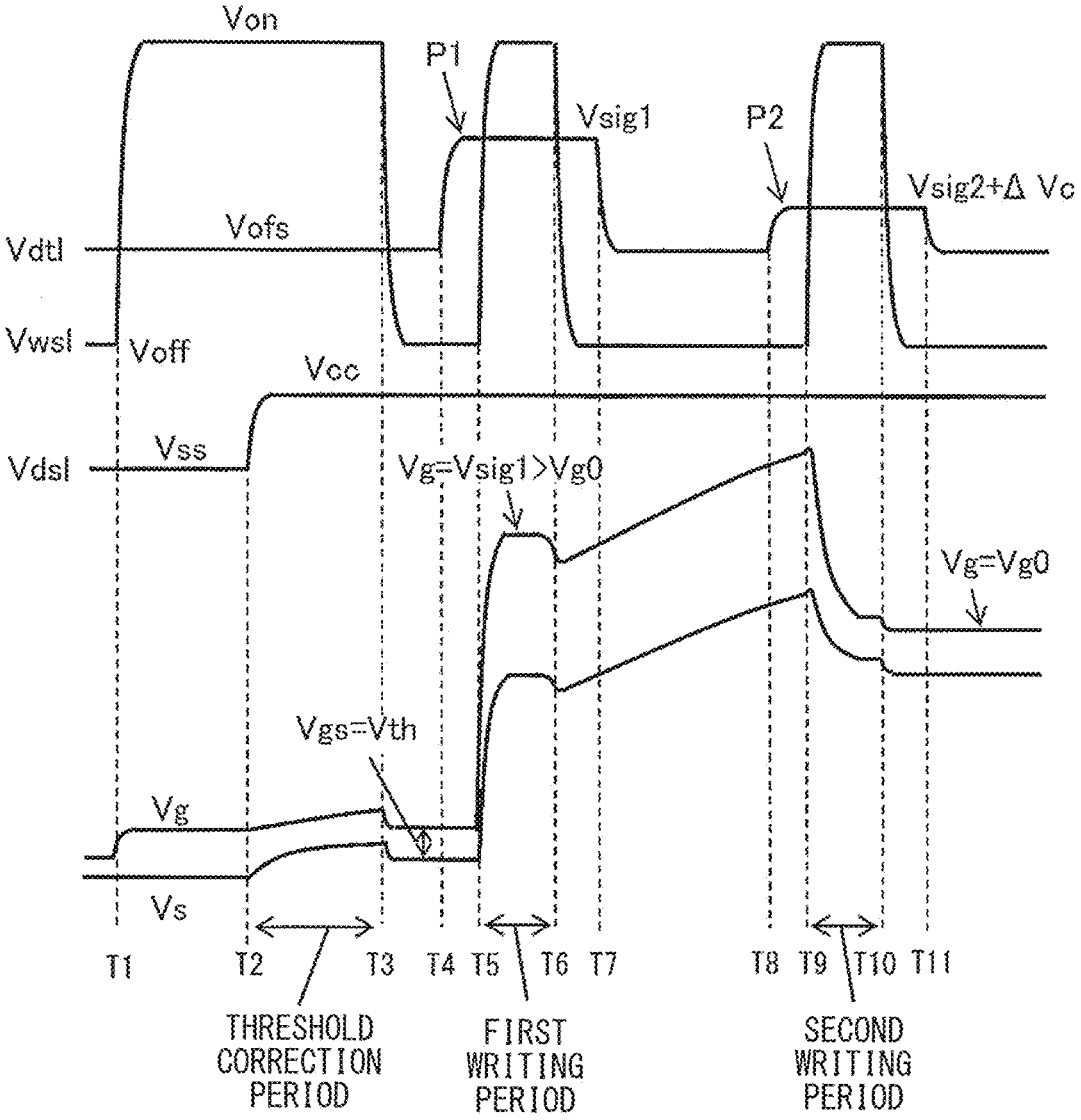
FIG. 6 is a chart illustrating example temporal changes in voltages respectively applied to a signal line, a scanning line, and power line, and example temporal changes in a gate voltage and a source voltage of a driving transistor in any of the pixels.

The voltage corrector 24 may calculate the signal voltages Vsig1 and Vsig2 and the correction voltage ΔVc on the basis of the image signal Db received from the signal processor 22. The signal voltages Vsig1 and Vsig2 may be used for a two-stage signal writing after a threshold correction. The signal voltage Vsig1 may correspond to a peak value of a voltage pulse P1 applied at a previous stage of the two-stage signal writing, as illustrated in FIG. 6 described below. The signal voltage Vsig2 may correspond to a peak value of a voltage corresponding to the image signal Din (i.e., gray-scale level). The correction voltage ΔVc may be added to the signal voltage Vsig2 to generate a voltage pulse P2, as illustrated in FIG. 6 described below. The voltage pulse P2 may be applied at a subsequent stage of the two-stage signal writing. The peak value of the voltage pulse P2 that is applied at the subsequent stage of the two-stage signal writing may be equal to the sum of the signal voltage Vsig2 and the correction voltage ΔVc, as illustrated in FIG. 6.

The signal voltage Vsig1 may correspond to a specific but non-limiting example of "peak value of first voltage pulse" according to one embodiment of the disclosure. The voltage pulse P1 having a peak value equal to the signal voltage Vsig1 may correspond to a specific but non-limiting example of "first voltage pulse" according to one embodiment of the disclosure. The signal voltage Vsig2 may correspond to a specific but non-limiting example of "signal voltage corresponding to image signal" according to one embodiment of the disclosure. The voltage pulse P2 having a peak value equal to the sum of the signal voltage Vsig2 and the correction voltage ΔVc may correspond to a specific but non-limiting example of "second voltage pulse" according to one embodiment of the disclosure.

The peak value of the voltage pulse P1 (i.e., the signal voltage Vsig1) is higher than the peak value of the voltage pulse P2 (i.e., the sum of the signal voltage Vsig2 and the correction voltage ΔVc). The peak value of the voltage pulse P1 (i.e., the signal voltage Vsig1) may be higher than the gate voltage Vg (=Vg0) of the driving transistor Tr2 of the organic electroluminescent element 11-2 in a light emission state. Such a voltage pulse P1 may serve to overshoot the gate voltage Vg of the driving transistor Tr1.

Figure 4:
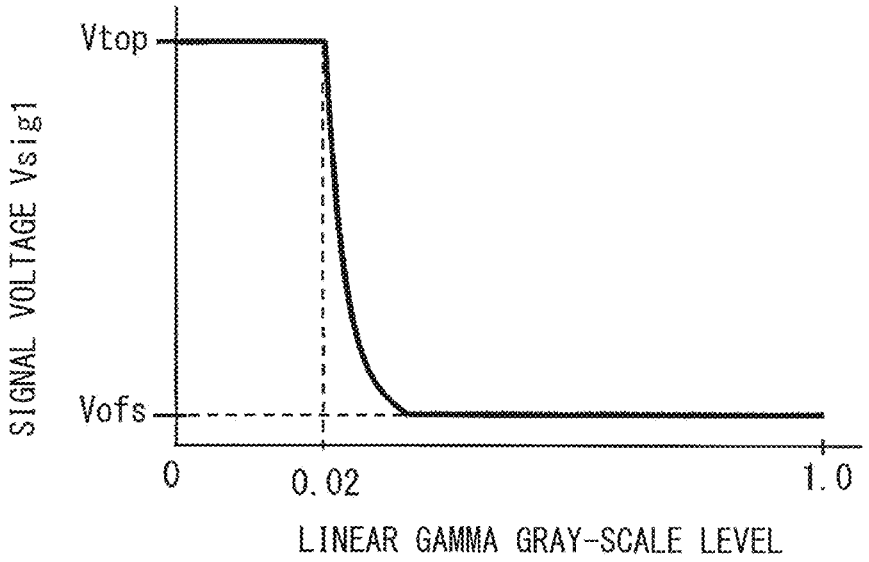
FIG. 4 is a graph illustrating an example relation between a linear gamma gray-scale level and a signal voltage applied at a previous stage.

In one example, the voltage corrector 24 may set the peak value of the voltage pulse P1 to a voltage greater than 0 volts only when the image signal Da or Db is at a low gray-scale level. In this example, as illustrated in FIG. 4, for example, the voltage corrector 24 may set the peak value of the voltage pulse P1 to a voltage Vtop only when the image signal Db (linear gamma gray-scale level) is not greater than a predetermined threshold. Note that the voltage Vtop may be higher than 0 volts and a voltage Vofs described below. When the image signal Da or Db is greater than the predetermined threshold, the voltage corrector 24 may set the peak value of the voltage pulse P1 to 0 volts or the voltage Vofs. Note that the voltage Vofs may be lower than the voltage Vtop described above. In this example, the voltage corrector 24 may moderately change the peak value of the voltage pulse P1 around the predetermined threshold, as illustrated in FIG. 4, for example. This suppresses a significant change in an image around the predetermined threshold. Alternatively, the voltage corrector 24 may set the peak value of the voltage pulse P1 over the entire gray-scale level.

Figure 5:
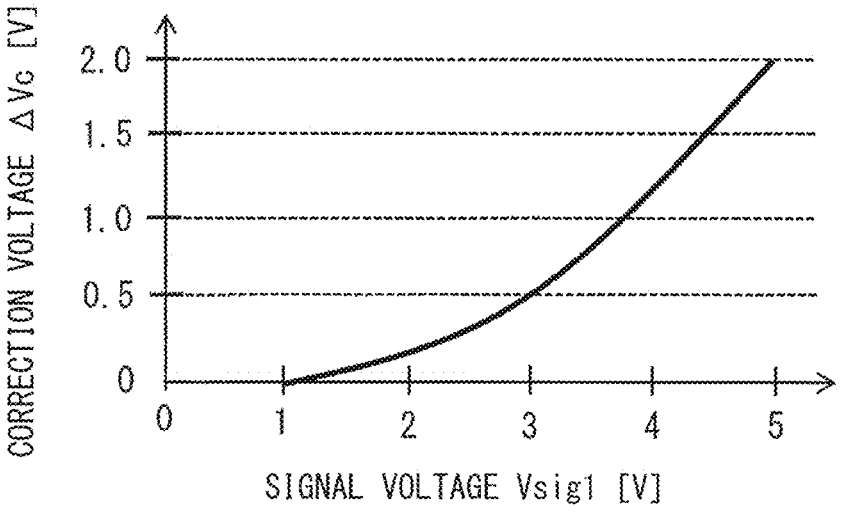
FIG. 5 is a graph illustrating an example relation between the signal voltage applied at the previous stage and a correction voltage.

The voltage corrector 24 may set the correction voltage ΔVc to a value based on the peak value of the signal voltage Vsig1. As illustrated in FIG. 5, for example, the voltage corrector 24 may increase the correction voltage ΔVc as the peak value of the signal voltage Vsig increases. In this case, the peak value of the signal voltage Vsig1 and the correction voltage ΔVc may satisfy the relation represented by the following expression:

$$y=0.1275x^2-0.2594x+0.1188$$

where x represents a value along a horizontal axis of the graph in FIG. 5, and y represents a value along a vertical axis of the graph in FIG. 5. Note that the expression described above is a mere example and the relation between the peak value of the signal voltage Vsig1 and the correction voltage ΔVc is not limited to the relation represented by the expression described above.

The timing controller 25 may output the control signal Tout to each circuit in the driver 30 in response to (in synchronization with) the image signal Dc, for example. The timing controller 25 may also output the analog voltage Vdt1 based on the image signal Dc to the driver 30, for example.

[Operation]

An operation (from light extinction to light emission) of the display unit 1 according to an example embodiment of the disclosure will now be described. The example embodiment of the disclosure may incorporate an operation that compensates a variation in I-V characteristic of the organic electroluminescent element 11-2 to keep luminance of the organic electroluminescent element 11-2 at a constant level without being affected by the variation in I-V characteristic of the organic electroluminescent element 11-2. Additionally, the example embodiment of the disclosure may incorporate an operation that corrects a change in the threshold voltage described above to keep luminance of the organic electroluminescent element 11-2 at a constant level without being affected by the temporal change in the threshold voltage Vth of the driving transistor Tr1.

FIG. 6 illustrates example temporal changes in the voltages applied to the signal line DTL, the scanning line WSL, and the power line DSL, and the gate voltage Vg and the source voltage Vs of the driving transistor Tr1, in any of the pixels 11.

Firstly, the controller 20 and the driver 30 may prepare for a threshold correction that causes the gate-source voltage Vgs of the driving transistor Tr1 to become closer to the threshold voltage Vth of the driving transistor Tr1. Before the preparation for the threshold correction, the organic electroluminescent element 11-2 may be in a light-emitting state. In this situation, the scanning line WSL may have a voltage Voff, and the power line DSL may have a voltage Vcc. The driving transistor Tr1 may operate in a saturated region. An electric current Ids flowing in the organic electroluminescent element 11-2 may thus be in accordance with the amount of the gate-source voltage Vgs of the driving transistor Tr1.

To start the preparation for the threshold correction, the controller 20 and the driver 30 may change the organic electroluminescent element 11-2 from the light emission state to a light-extinction state. For example, the power scanner 33 may reduce the voltage of the power line DSL from the voltage Vcc to the voltage Vss in response to a control signal from the controller 20. Note that the voltage Vss may be lower than the sum of the threshold voltage Vthe1 and the cathode voltage Vcath (Vthe1+Vcath) of the organic electroluminescent element 11-2. Accordingly, when the source voltage Vs is reduced to the voltage Vss, the organic electroluminescent element 13 may become the light-extinction state. At the same time, the gate voltage Vg may also be reduced owing to coupling via the storage capacitor Cs.

Thereafter, at a time T1, the write scanner 32 may increase the voltage of the scanning line WSL from the voltage Voff to the voltage Von in response to a control signal from the controller 20 while the power line DSL is at the voltage Vss and the signal line DTL is at the voltage Vofs. This may change the gate voltage Vg to the voltage Vofs. In this situation, a difference between the voltage Vofs and the voltage Vss (i.e., Vofs−Vss) may be higher than the threshold voltage Vth of the driving transistor Tr1.

Thereafter, the controller 20 and the driver 30 may perform the threshold correction of the driving transistor Tr1. For example, at a time T2, the power scanner 33 may increase the voltage of the power line DSL from the voltage Vss to the voltage Vcc in response to a control signal from the controller 20 while the signal line DTL is at the voltage Vofs and the scanning line WSL is at the voltage Von. This may cause an electric current to flow between the drain and the source of the driving transistor Tr1, and the source voltage Vs to increase. In this case, when the source voltage Vs is lower than the difference between the voltage Vofs and the threshold voltage Vth (Vofs−Vth) (i.e., when the threshold correction has not been completed yet), an electric current may keep flowing between the drain and the source of the driving transistor Tr1 to charge the storage capacitor Cs until the driving transistor Tr1 is cut-off (i.e., until the gate-source voltage becomes the voltage Vth). In this situation, the source voltage Vs of the driving transistor Tr1 may increase with time. As a result, the gate voltage Vg may become equal to the voltage Vofs, the storage capacitor Cs may be charged, and the gate-source voltage Vgs may become equal to the threshold voltage Vth.

Thereafter, at a time T3, the write scanner 32 may reduce the voltage of the scanning line WSL from the voltage Von to the voltage Voff in response to a control signal from the controller 20. This may cause the gate of the driving transistor Tr1 to become a floating state. While the gate-source voltage Vgs is equal to the threshold voltage Vth, an electric current may stop flowing between the drain and the source of the driving transistor Tr1, and the charging of the storage capacitor Cs may be halted. In this situation, the source voltage Vs of the driving transistor Tr1 may become equal to the voltage Vofs−Vth that is equal to or lower than Vthe1+Vcat. Accordingly, the organic electroluminescent element 11-2 may remain in the light extinction state.

Thereafter, the controller 20 and the driver 30 may perform writing of the signal voltage Vsig and mobility compensation. Note that the signal voltage Vsig may correspond to the image signal Din. The mobility compensation may be an operation that corrects the voltage held between the gate and the source of the driving transistor Tr1 (i.e., the gate-source voltage Vgs) in accordance with the amount of mobility of the driving transistor Tr1. After the threshold correction, the controller 20 and the driver 30 may apply a voltage pulse to the gate of the switching transistor Tr2 twice to write the signal voltage Vsig2 to the gate of the driving transistor Tr1. Note that the signal voltage Vsig2 may correspond to the image signal Din.

In one example, the horizontal selector 31 may first output the voltage pulse P1 having a peak value Vsig1 to the signal line DTL in response to a control signal from the controller 20. This may switch the voltage of the signal line DTL from the voltage Vofs to the voltage Vsig1 at a time T4. Thereafter, at a time T5, the write scanner 32 may increase the voltage of the scanning line WSL from the voltage Voff to the voltage Von to couple the gate of the driving transistor Tr1 to the signal line DTL in response to a control signal from the controller 20. This may cause the gate voltage Vg of the driving transistor Tr1 to become equal to the voltage Vsig1 of the signal line DTL. At this time, the source voltage Vs of the driving transistor Tr1 may increase with the increase in the gate voltage Vg. The write scanner 32 may also reduce the voltage of the scanning line WSL from the voltage Von to the voltage Voff in response to a control signal from the controller 20 at a time T6. This may cause the gate of the driving transistor Tr1 to become a floating state, an electric current Ids to flow between the drain and the source of the driving transistor Tr1, the source voltage Vs to increase, and the gate voltage Vg to increase accordingly. Immediately afterwards, at a time T7, the horizontal selector 31 may switch the voltage of the signal line DTL from the voltage Vsig1 to the voltage Vofs to halt the output of the voltage pulse P1 in response to a control signal from the controller 20.

Thereafter, at a time T8, the horizontal selector 31 may output the voltage pulse P2 having a peak value of Vsig2+ΔVc to the signal line DTL in response to a control signal from the controller 20. This may switch the voltage of the signal line DTL from the voltage Vofs to the voltage Vsig2. Thereafter, at a time T9, the write scanner 32 may increase the voltage of the scanning line WSL from the voltage Voff to the voltage Von to couple the gate of the driving transistor Tr1 to the signal line DTL in response to a control signal from the controller 20. This may cause the gate voltage Vg of the driving transistor Tr1 to become equal to the voltage of Vsig2+ΔVc of the signal line DTL. At this time, the source voltage Vs of the driving transistor Tr1 may decrease with the decrease in the gate voltage Vg.

In this situation, the anode voltage of the organic electroluminescent element 11-2 may still remain lower than the threshold voltage Ve1 of the organic electroluminescent element 11-2, and the organic electroluminescent element 11-2 may be cut-off. Accordingly, an electric current between the gate and the source of the driving transistor Tr1 may flow in the capacitor Coled of the organic electroluminescent element 11-2 to charge the capacitor Coled. This may cause the source voltage Vs to shift by a voltage ΔVs, and eventually, the gate-source voltage Vgs to become a voltage Vsig2+ΔVc+Vth−ΔVs. In such a manner, the mobility compensation may be performed in parallel with the writing. Note that the voltage ΔVs may increase as the mobility of the driving transistor Tr1 increases. The gate-source voltage Vgs may thus be reduced by the voltage ΔVs before light emission to eliminate variations in the mobility between the pixels 11.

Thereafter, at a time T10, the write scanner 32 may reduce the voltage of the scanning line WSL from the voltage Von to the voltage Voff in response to a control signal from the controller 20. This may cause the gate of the driving transistor Tr1 to become a floating state, an electric current Ids to flow between the drain and the source of the driving transistor Tr1, the source voltage Vs to decrease, and the gate voltage Vg to decrease accordingly. Immediately afterwards, at a time T11, the horizontal selector 31 may switch the voltage of the signal line DTL from the voltage Vsig2+ΔVc to the voltage Vofs to halt the output of the voltage pulse P2 in response to a control signal from the controller 20. Note that the gate-source voltage Vgs of the driving transistor Tr1 may be constant. The driving transistor Tr1 may thus supply the organic electroluminescent element 11-2 with a constant electric current Ids to cause the organic electroluminescent element 11-2 to emit light at a desired luminance.

Figure 7:
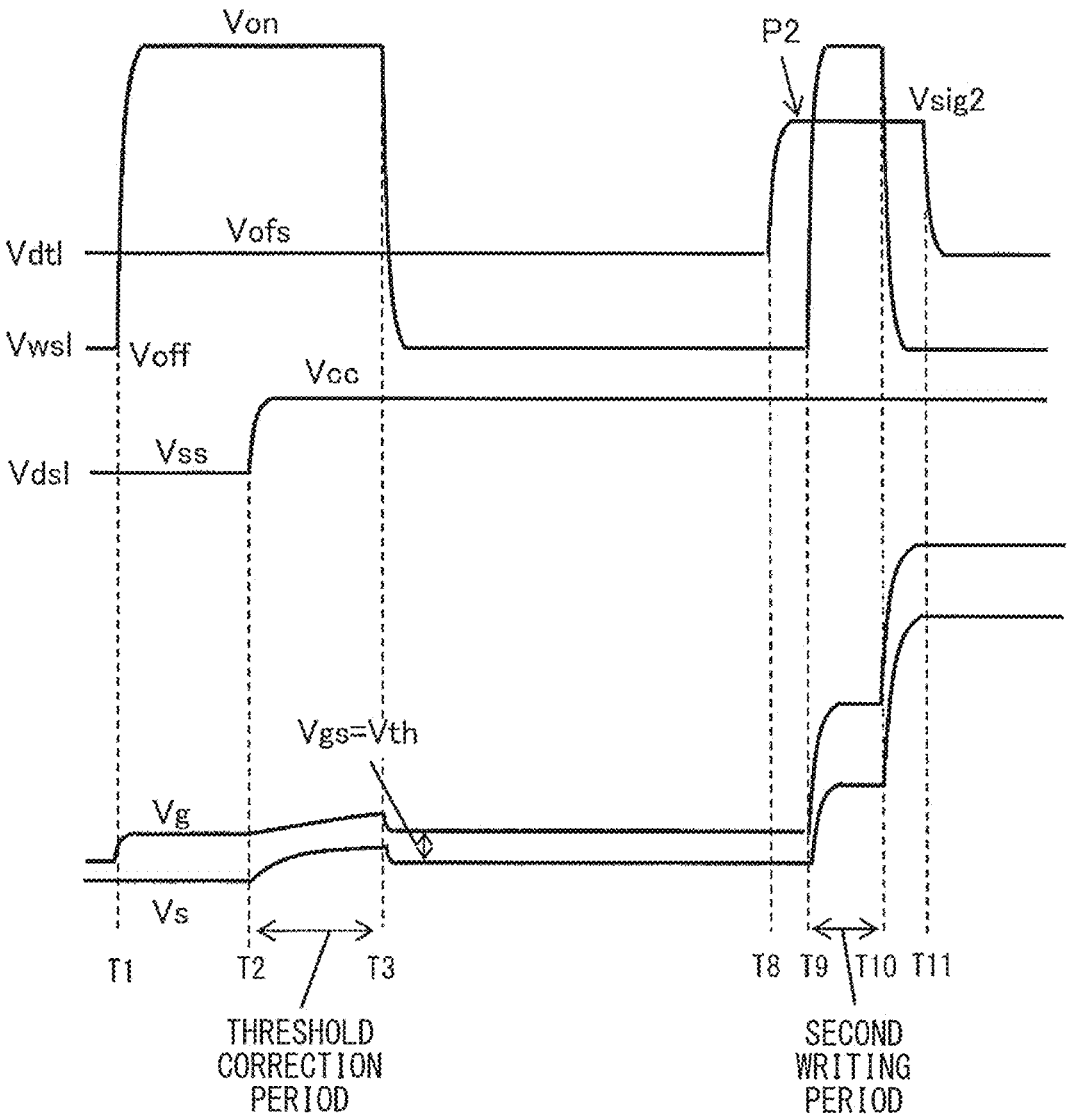
FIG. 7 is a chart illustrating example temporal changes in the voltages respectively applied to the signal line, the scanning line, and the power line, and example temporal changes in the gate voltage and the source voltage of the driving transistor in any of the pixels.

Alternatively, the controller 20 and the driver 30 may apply the voltage pulse P1 to the gate of the driving transistor Tr1 only when the image signal Da or Db is at a low gray-scale level. For example, as illustrated in FIG. 7, when the image signal Da or Db is not at a low gray-scale level (e.g., when the image signal Da or Db is at a high gray-scale level), the controller 20 and the driver 30 may output only the voltage pulse P2 without outputting the voltage pulse P1 in the writing. Still alternatively, the controller 20 and the driver 30 may apply the voltage pulses P1 and P2 to the gate of the driving transistor Tr1 regardless of the gray-scale level of the image signal Da or Db.

[Example Effects]

Some effects of the display unit 1 according to an example embodiment of the disclosure will now be described with reference to a comparative example.

Figure 8:
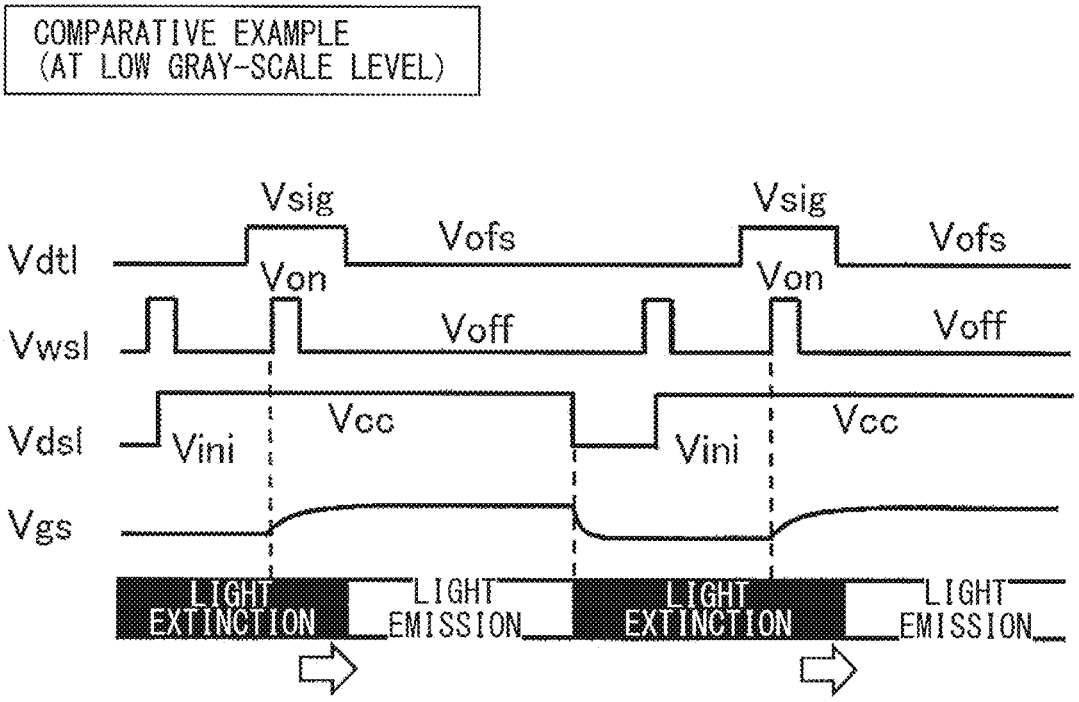
FIG. 8 is a chart schematically illustrating light emission and light extinction of a light-emitting unit according to a comparative example at a low gray-scale level.
Figure 9:
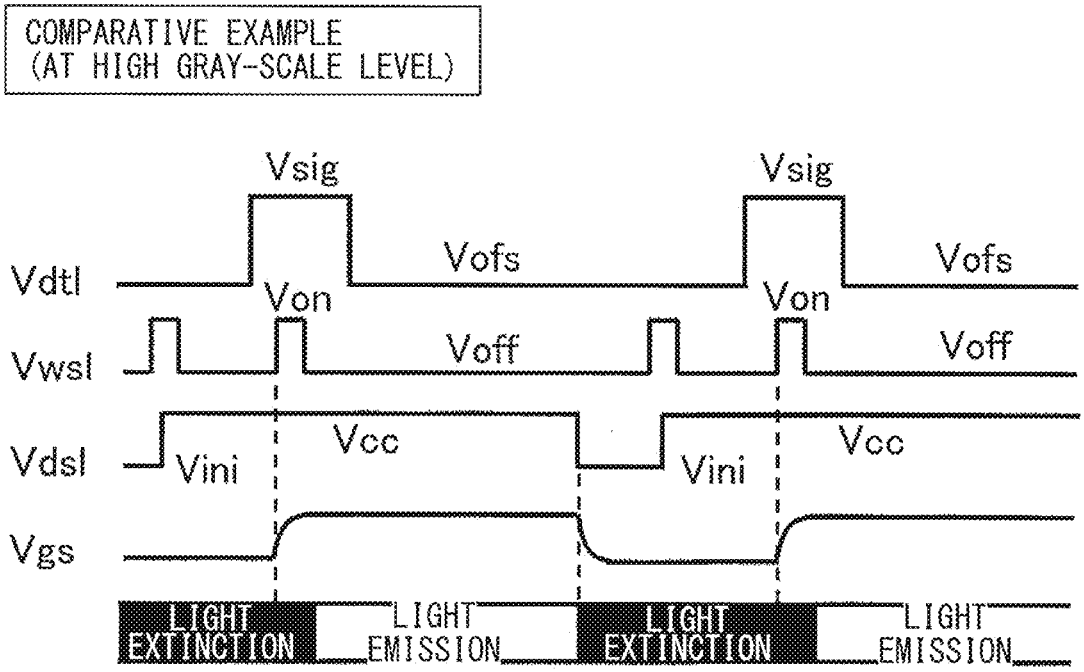
FIG. 9 is a chart schematically illustrating light emission and light extinction of the light-emitting unit according to the comparative example at a high gray-scale level.
Figure 10:
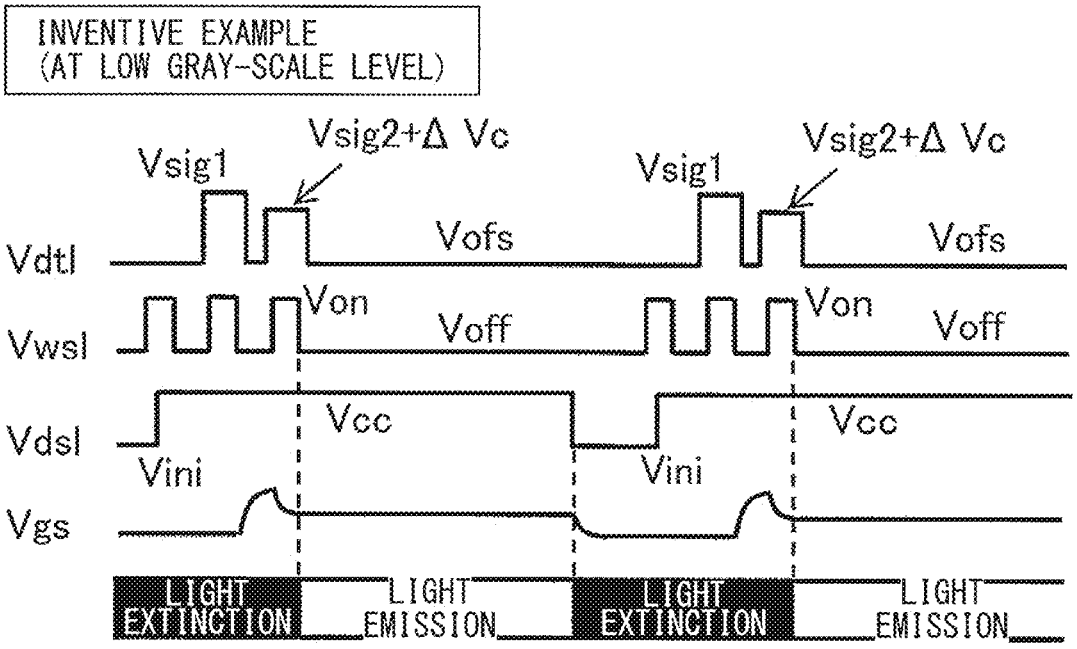
FIG. 10 is a chart schematically illustrating light emission and light extinction of a light-emitting unit according to one example embodiment of the disclosure at a low gray-scale level.
Figure 11:
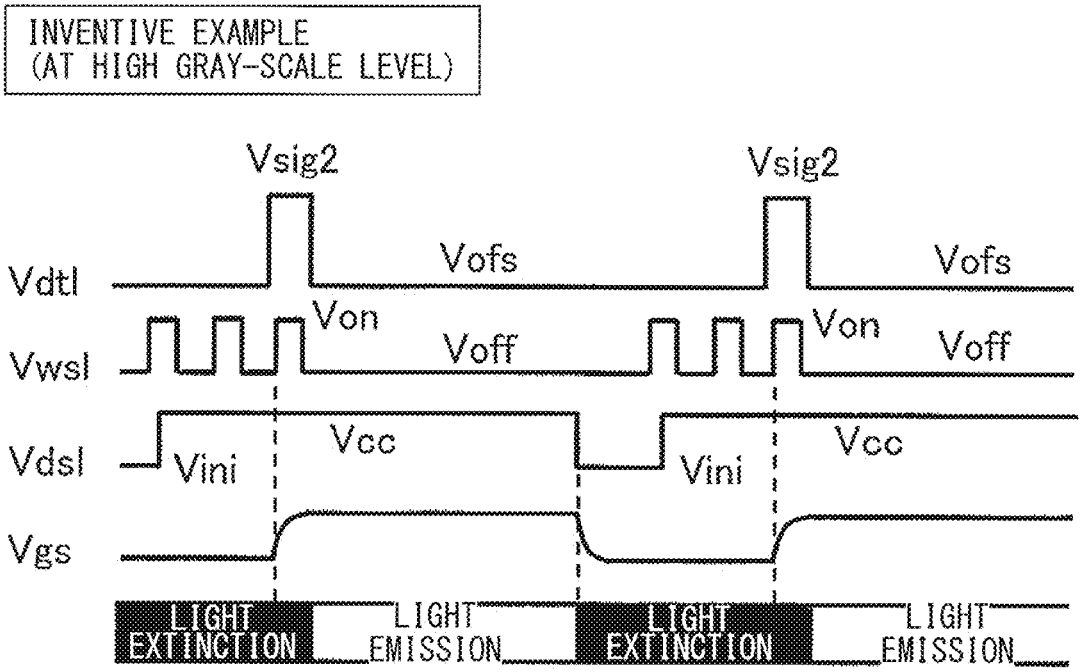
FIG. 11 is a chart schematically illustrating light emission and light extinction of the light-emitting unit according to one example embodiment of the disclosure at a high gray-scale level.

FIG. 8 schematically illustrates light emission and light extinction of a light-emitting unit according to the comparative example at a low gray-scale level. FIG. 9 schematically illustrates light emission and light extinction of the light-emitting unit according to the comparative example at a high gray-scale level. FIG. 10 schematically illustrates light emission and light extinction of a light-emitting unit according to an example embodiment of the disclosure at a low gray-scale level. FIG. 11 schematically illustrates light emission and light extinction of the light-emitting unit according to an example embodiment of the disclosure at a high gray-scale level.

In the light-emitting unit according to the comparative example, an emission response is slower at a low gray-scale level than at a high gray-scale level. Accordingly, a dark image becomes more visible at a low frame rate, which gives a user an impression that flickers are occurring. In an example where the threshold correction accounts for 5% of one frame period, an emission duty is 95% at a maximum. When a delay of the emission response at a low luminance level accounts for 2.5% of one frame period, the emission duty is 92.5%. When the emission duty is 92.5% and a frame rate is set at a low frame rate of 40 Hz or lower, for example, flickers are visually observed by a user.

In contrast, in the example embodiment of the disclosure, the two voltage pulses P1 and P2 may be applied to the signal line DTL upon the signal writing after the threshold correction, as illustrated in FIG. 10, for example. In this example embodiment, the two voltage pulses P1 and P2 may be applied to the gate of the driving transistor Tr1 through the switching transistor Tr2. As apparent from FIGS. 10 and 11, this causes a timing of light emission upon the application of the voltage pulse P2 at a low gray-scale level to become closer to the timing of light emission upon the application of the voltage pulse P2 at a high gray-scale level. In other words, the applications of voltage pulses P1 and P2 suppress a delay of the emission response. As a result, a period of light extinction becomes shorter in the example embodiment than in the comparative example where a single voltage pulse is applied in the writing. Accordingly, it is possible to suppress generation of flickers.

Furthermore, in the example embodiment of the disclosure, the peak value of the voltage pulse P1 may be higher than the peak value of the voltage pulse P2. This causes the timing of light emission upon the application of the voltage pulse P2 at a low gray-scale level to become close to the timing of light emission upon the application of the voltage pulse P2 at a high gray-scale level, and suppresses a delay of the emission response. As a result, a period of light extinction becomes shorter in the example embodiment than in the comparative example where a single voltage pulse is applied in the writing. Accordingly, it is possible to suppress generation of flickers.

Furthermore, in the example embodiment of the disclosure, the peak value of the voltage pulse P2 may be equal to the sum of the signal voltage Vsig2 and the correction voltage ΔVc. Accordingly, when the voltage pulse P2 is applied after the application of the voltage pulse P1, the gate-source voltage Vgs of the driving transistor Tr1 is corrected by the voltage pulse P2. In other words, mobility compensation is properly performed even in the example embodiment where the voltage pulses P1 and P2 are applied.

Additionally, in the example embodiment of the disclosure, the peak value of the voltage pulse P1 may be higher than the gate voltage Vg of the driving transistor Tr2 of the organic electroluminescent element 11-2 in a light emission state. The application of the voltage pulse P1 thus causes overshooting of the gate voltage Vg of the driving transistor Tr1. This causes the timing of light emission upon the application of the voltage pulse P2 at a low gray-scale level to become closer to the timing of light emission upon the voltage pulse P2 at a high gray-scale level. In other words, the applications of voltage pulses P1 and P2 suppress a delay of the emission response in the example embodiment of the disclosure. As a result, a period of light extinction becomes shorter in the example embodiment than in the comparative example where a single voltage pulse is applied in the writing. Accordingly, it is possible to suppress generation of flickers.

Additionally, in the example embodiment of the disclosure, the voltage pulse P1 may be applied to the gate of the driving transistor Tr1 only when the image signal Db is at a low gray-scale level. This reduces a voltage to be generated at the controller 20, compared with the case where the voltage pulse P1 is applied to the gate of the driving transistor Tr1 at a high gray-scale level. Accordingly, it is possible to suppress generation of flickers while suppressing an increase in power consumption.

2. Modification Examples

Some modification examples of the display unit 1 according to the foregoing example embodiment of the disclosure will now be described. In a modification example, the controller 20 may apply the voltage pulses P1 and P2 to each of the pixels 11 regardless of a gray-scale level. In this modification example, the pixel circuit 11-1 in each of the pixels 11 may include a control device, such as a switch, that controls the application of the voltage pulse P1 to the organic electroluminescent element 11-2 in response to a control signal from the controller 20.

In another modification example, the controller 20 and the driver 30 may apply three or more voltage pulses including the voltage pulses P1 and P2 to perform the signal writing after the threshold correction. For example, the controller 20 and the driver 30 may apply voltage pulses three times or more (i.e., apply three or more voltage pulses including the voltage pulses P1 and P2) to the gate of the switching transistor Tr2 after the threshold correction, to write the signal voltage Vsig2 into the gate of the driving transistor Tr1. Note that the signal voltage Vsig2 may correspond to the image signal Din. Out of the voltage pulses applied in the signal writing after the threshold correction, the voltage pulse P1 has a peak value (i.e., the signal voltage Vsig1) higher than the peak value of the voltage pulse P2. Note that the peak value of the voltage pulse P2 may be equal to the sum of the signal voltage Vsig2 and the correction voltage ΔVc. The display unit according to the modification example also provides a similar or the same effect as the display unit 1 according to the foregoing example embodiment and the foregoing modification example of the disclosure.

3. Application Examples

Some application examples of the display unit 1 according to the foregoing example embodiments and modification examples will now be described. The display unit 1 according to the foregoing example embodiments and the foregoing modification examples may be applied to a display unit of a variety of electronic apparatuses that display an external or internal image signal in the form of an image or a video image. Specific but non-limiting examples of the electronic apparatuses may include television apparatuses, digital cameras, notebook personal computers, terminal devices such as mobile phones, and video cameras.

Figure 12:
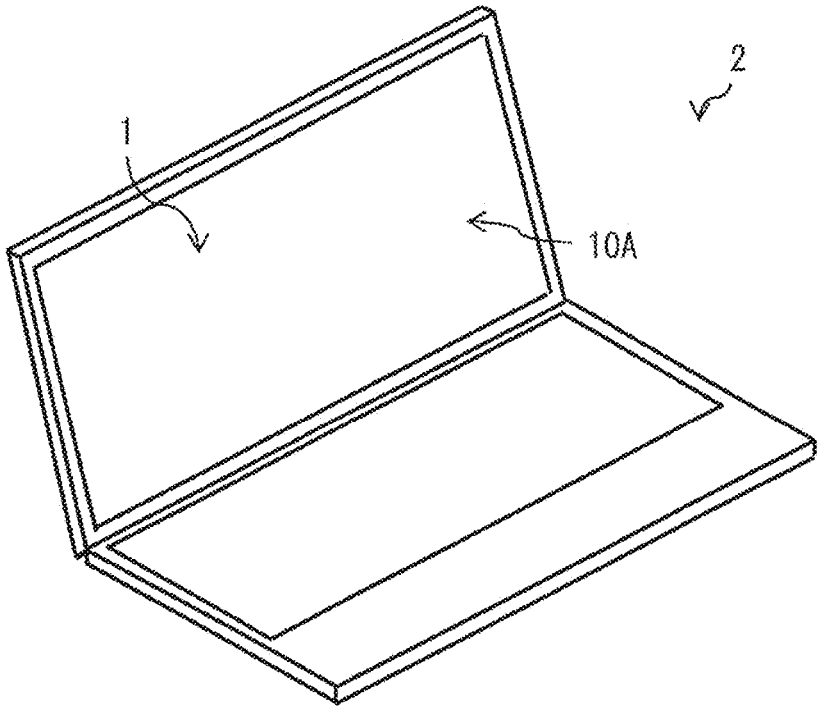
FIG. 12 is a perspective view of an example appearance of the display unit illustrated in FIG. 1 according to one application example of the disclosure.

FIG. 12 schematically illustrates an example configuration of an electronic apparatus 2 according to an application example of one example embodiment of the disclosure. The electronic apparatus 2 may be a notebook personal computer having a foldable body that includes two plate-like members. One of the plate-like members may have an image display surface on a main face thereof. The electronic apparatus 2 may include the display unit 1 according to any foregoing embodiment or modification example of the disclosure. For example, the image display surface 10A of the display panel 10 may be provided at a position of the image display surface of the electronic apparatus 2. In the application example that includes the display unit 1 according to the foregoing example embodiment or modification example, it is possible to suppress generation of flickers.

Although the disclosure is described with reference to the example embodiments, modification examples, and application examples hereinabove, these example embodiments, modification examples, and application examples are not to be construed as limiting the scope of the disclosure and may be modified in a wide variety of ways. It should be appreciated that the effects described herein are mere examples. Effects of the example embodiment, modification examples, and application examples of the disclosure are not limited to those described herein, and may be different from those described herein. The disclosure may further include any effects other than those described herein.

It is possible to achieve at least the following configurations from the foregoing example embodiments, the foregoing modification examples, and the foregoing application examples of the disclosure.

(1) A method of driving a display panel, the display panel including a plurality of pixels, each of the pixels including a light-emitting element and a pixel circuit, the pixel circuit including a first transistor and a second transistor, the first transistor being configured to control an electric current flowing in the light-emitting element, the second transistor being configured to control an application of a voltage to a gate of the first transistor, the method including:

correcting a gate-source voltage of the first transistor in any of the pixels to cause the gate-source voltage of the first transistor to become closer to a threshold voltage of the first transistor; and writing, after the correcting the gate-source voltage, a signal voltage into the gate of the first transistor in the any of the pixels by applying a plurality of voltage pulses to a gate of the second transistor, the signal voltage corresponding to an image signal, the voltage pulses applied in the writing including a first voltage pulse and a second voltage pulse, the first voltage pulse being applied previous to the second voltage pulse, the second voltage pulse being applied subsequent to the first voltage pulse, a peak value of the first voltage pulse being higher than a peak value of the second voltage pulse.

(2) The method according to (1), in which the peak value of the second voltage pulse is higher than the signal voltage corresponding to the image signal.

(3) The method according to (2), in which the peak value of the second voltage pulse is equal to a sum of the signal voltage corresponding to the image signal and a correction voltage based on an amount of the peak value of the first voltage pulse.

(4) The method according to any one of (1) to (3), in which the peak value of the first voltage pulse is higher than a gate voltage of the first transistor of the light-emitting element in a light emission state.

(5) The method according to any one of (1) to (4), in which the first voltage pulse is applied to the gate of the first transistor in the writing only when the image signal is at a low gray-scale level.

(6) A driving circuit configured to drive a display panel, the display panel including a plurality of pixels, each of the pixels including a light-emitting element and a pixel circuit, the pixel circuit including a first transistor and a second transistor, the first transistor being configured to control an electric current flowing in the light-emitting element, the second transistor being configured to control an application of a voltage to a gate of the first transistor, the driving circuit including:

writing circuitry configured to correct a gate-source voltage of the first transistor in any of the pixels to cause the gate-source voltage to become closer to a threshold voltage of the first transistor, and write, after correcting the gate-source voltage, a signal voltage into the gate of the first transistor in the any of the pixels by applying a plurality of voltage pulses to a gate of the second transistor, the signal voltage corresponding to an image signal, the voltage pulses applied when the writing circuitry writes the signal voltage including a first voltage pulse and a second voltage pulse, the first voltage pulse being applied previous to the second voltage pulse, the second voltage pulse being applied subsequent to the first voltage pulse, a peak value of the first voltage pulse being higher than a peak value of the second voltage pulse.

(7) A display unit including:

a display panel including a plurality of pixels, each of the pixels including a light emitting element and a pixel circuit, the pixel circuit including a first transistor and a second transistor, the first transistor being configured to control an electric current flowing in the light-emitting element, the second transistor being configured to control an application of a voltage to a gate of the first transistor; and a driving circuit configured to drive the display panel, the driving circuit being configured to correct a gate-source voltage of the first transistor in any of the pixels to cause the gate-source voltage to become closer to a threshold voltage of the first transistor, and write, after correcting the gate-source voltage, a signal voltage into the gate of the first transistor in the any of the pixels by applying a plurality of voltage pulses to a gate of the second transistor, the signal voltage corresponding to an image signal, the voltage pulses applied when the writing circuitry writes the signal voltage including a first voltage pulse and a second voltage pulse, the first voltage pulse being applied previous to the second voltage pulse, the second voltage pulse being applied subsequent to the first voltage pulse, a peak value of the first voltage pulse being higher than a peak value of the second voltage pulse.

According to the method of driving the display panel, the driving circuit, and the display unit according to an example embodiment of the disclosure, a plurality of voltage pulses may be applied in the writing. Out of the voltage pulses, the first voltage pulse has a peak value higher than the peak value of the second voltage pulse. This suppresses a delay of emission response upon the application of the second voltage pulse. As a result, a period of light extinction becomes shorter in the example embodiment than in a case where a single voltage pulse is applied in the writing.

According to the method of driving the display panel, the driving circuit, and the display unit according to an example embodiment of the disclosure, a period of light extinction becomes shorter than in the case where a single voltage pulse is applied to perform writing. Accordingly, it is possible to suppress generation of flickers. It should be understood that effects of the example embodiments, modification examples, and application examples of the disclosure are not limited to those described hereinabove, and may be any effect described herein.

Although the disclosure is described hereinabove in terms of example embodiments, modification examples, and application examples, it is not limited thereto. It should be appreciated that variations may be made in the example embodiments, modification examples, and application examples described herein by persons skilled in the art without departing from the scope of the disclosure as defined by the following claims. The limitations in the claims are to be interpreted broadly based on the language employed in the claims and not limited to examples described in this specification or during the prosecution of the application, and the examples are to be construed as non-exclusive. For example, in this disclosure, the use of the terms first, second, etc. do not denote any order or importance, but rather the terms first, second, etc., are used to distinguish one element from another. The term "disposed on/provided on/formed on" and its variants as used herein refer to elements disposed directly in contact with each other or indirectly by having intervening structures therebetween. Moreover, no element or component in this disclosure is intended to be dedicated to the public regardless of whether the element or component is explicitly recited in the following claims.

What is claimed is:

1. A method of driving a display panel, the display panel including a plurality of pixels, each of the pixels including a light-emitting element and a pixel circuit, the pixel circuit including a first transistor and a second transistor, the first transistor being configured to control an electric current flowing in the light-emitting element, the second transistor being configured to control an application of a voltage to a gate of the first transistor, the method comprising:

correcting a gate-source voltage of the first transistor in a pixel of the plurality of pixels to cause the gate-source voltage of the first transistor to become closer to a threshold voltage of the first transistor; and writing, after the correcting the gate-source voltage, a signal voltage to the gate of the first transistor in the pixel by applying a plurality of pulses to a gate of the second transistor, wherein the signal voltage corresponds to an image signal, applying a first pulse of the plurality of pulses writes a first voltage pulse to the gate of the first transistor, applying a second pulse of the plurality of pulses writes a second voltage pulse to the gate of the first transistor, the first voltage pulse being written to the gate of the first transistor prior to the second voltage pulse, and a peak value of the first voltage pulse being higher than a peak value of the second voltage pulse.

2. The method according to claim 1, wherein the peak value of the second voltage pulse is higher than the signal voltage corresponding to the image signal.

3. The method according to claim 2, wherein the peak value of the second voltage pulse is equal to a sum of the signal voltage corresponding to the image signal and a correction voltage based on an amount of the peak value of the first voltage pulse.

4. The method according to claim 1, wherein the peak value of the first voltage pulse is higher than a gate voltage of the first transistor of the light-emitting element in a light emission state.

5. The method according to claim 1, wherein the first voltage pulse is applied to the gate of the first transistor in the writing only when the image signal is at a low gray-scale level.

6. A driving circuit configured to drive a display panel, the display panel including a plurality of pixels, each of the pixels including a light-emitting element and a pixel circuit, the pixel circuit including a first transistor and a second transistor, the first transistor being configured to control an electric current flowing in the light-emitting element, the second transistor being configured to control an application of a voltage to a gate of the first transistor, the driving circuit comprising:

writing circuitry configured to correct a gate-source voltage of the first transistor in a pixel of the plurality of pixels to cause the gate-source voltage to become closer to a threshold voltage of the first transistor, and write, after correcting the gate-source voltage, a signal voltage to the gate of the first transistor in the pixel by applying a plurality of pulses to a gate of the second transistor, wherein the signal voltage corresponds to an image signal, the writing circuitry is configured to write a first voltage pulse during a first pulse of the plurality of pulses and to write a second voltage pulse during a second pulse of the plurality of pulses, the first voltage pulse being applied prior to the second voltage pulse, and a peak value of the first voltage pulse being higher than a peak value of the second voltage pulse.

7. A display unit comprising:

a display panel including a plurality of pixels, each of the pixels including a light emitting element and a pixel circuit, the pixel circuit including a first transistor and a second transistor, the first transistor being configured to control an electric current flowing in the light-emitting element, the second transistor being configured to control an application of a voltage to a gate of the first transistor; and a driving circuit configured to drive the display panel, the driving circuit being configured to correct a gate-source voltage of the first transistor in a pixel of the plurality of pixels to cause the gate-source voltage to become closer to a threshold voltage of the first transistor, and write, after correcting the gate-source voltage, a signal voltage to the gate of the first transistor in the pixel by applying a plurality of pulses to a gate of the second transistor, wherein the signal voltage corresponds to an image signal, the writing circuitry is configured to write a first voltage pulse during a first pulse of the plurality of pulses and to write a second voltage pulse during a second pulse of the plurality of pulses, the first voltage pulse being applied prior to the second voltage pulse, a peak value of the first voltage pulse being higher than a peak value of the second voltage pulse.

* * * * *